US012522899B2

(12) United States Patent
Kato et al.

(10) Patent No.: US 12,522,899 B2
(45) Date of Patent: Jan. 13, 2026

(54) Fe—Co-BASED ALLOY BAR

(71) Applicant: Proterial, Ltd., Tokyo (JP)

(72) Inventors: Daiki Kato, Tokyo (JP); Hidetaka Yakabe, Tokyo (JP); Masaru Fujiyoshi, Tokyo (JP); Shujiroh Uesaka, Tokyo (JP); Shinsuke Sasabe, Tokyo (JP)

(73) Assignee: Proterial, Ltd., Tokyo (JP)

( * ) Notice: Subject to any disclaimer, the term of this patent is extended or adjusted under 35 U.S.C. 154(b) by 153 days.

(21) Appl. No.: 18/037,073

(22) PCT Filed: Sep. 14, 2021

(86) PCT No.: PCT/JP2021/033818
§ 371 (c)(1),
(2) Date: May 15, 2023

(87) PCT Pub. No.: WO2023/042278
PCT Pub. Date: Mar. 23, 2023

(65) Prior Publication Data

US 2024/0026503 A1 Jan. 25, 2024

(51) Int. Cl.

| | |
|---|---|
| ***C22C 30/00*** | (2006.01) |
| ***C21D 8/06*** | (2006.01) |
| ***C21D 8/12*** | (2006.01) |
| *C21D 1/08* | (2006.01) |

(52) U.S. Cl.
CPC ..... *C22C 30/00* (2013.01); *C21D 8/065* (2013.01); *C21D 8/1205* (2013.01); *C21D 8/1222* (2013.01); *C21D 8/1261* (2013.01); *C21D 8/1272* (2013.01); *C21D 2201/05* (2013.01); *C22C 2202/02* (2013.01)

(58) Field of Classification Search
CPC ..... C22C 38/10
See application file for complete search history.

(56) References Cited

U.S. PATENT DOCUMENTS

| | | | | |
|---|---|---|---|---|
| 5,919,319 | A * | 7/1999 | Couderchon | C22C 38/10 148/309 |
| 6,153,020 | A | 11/2000 | Chen et al. | |
| 7,128,790 | B2 | 10/2006 | Waeckerle et al. | |
| 2008/0099106 | A1 | 5/2008 | Pieper et al. | |
| 2009/0184790 | A1 | 7/2009 | Pieper et al. | |
| 2014/0338793 | A1 | 11/2014 | Leary et al. | |
| 2018/0119241 | A1 | 5/2018 | Susan et al. | |

FOREIGN PATENT DOCUMENTS

| | | |
|---|---|---|
| CN | 1596321 | 3/2005 |
| CN | 102296238 | 12/2011 |
| CN | 103691741 | 4/2014 |
| CN | 104708005 | 6/2015 |
| CN | 108130493 | 6/2018 |
| CN | 115279926 | 11/2022 |
| GB | 896881 | 5/1962 |
| GB | 1415552 | 11/1975 |
| JP | S5224915 | 2/1977 |
| JP | S61130419 | 6/1986 |
| JP | H05195170 | 8/1993 |
| JP | H05279784 | 10/1993 |
| JP | H05304014 | 11/1993 |
| JP | H07166239 | 6/1995 |
| JP | H08300044 | 11/1996 |
| JP | 2002194475 | 7/2002 |
| JP | 2004515644 | 5/2004 |
| JP | 2004277842 | 10/2004 |
| JP | 2006336038 | 12/2006 |
| JP | 2020025077 | 2/2020 |
| KR | 20020095108 | 12/2002 |
| WO | 2019059256 | 3/2019 |
| WO | 2021182518 | 9/2021 |

OTHER PUBLICATIONS

Wu Lai-Zhi et al, "Microstructures of ultra-fine grained FeCoV alloys processed by ECAP plus cold rolling and their evolutions during tempering", Transactions of Nonferrous Metals Society of China, Apr. 2010, pp. 602-606.
L.C. Zhang et al, "Deformation-induced grain refinement in body-centered cubic Co—Fe alloys upon room temperature compression", Materials Science and Engineering: A, Aug. 2010, pp. 5796-5800.
Brahim Nabi et al, "Effect of long range order on mechanical properties of partially recrystallized Fe49Co—2V alloy", Materials Science and Engineering: A, Nov. 2013, pp. 70-76.
Shihao Li et al, "3D printing of ductile equiatomic Fe—Co alloy for soft magnetic applications", Additive Manufacturing, Sep. 2021, pp. 1-21.
Mohammad R. Kamali et al, "Reobservations of ferrite recrystallization in a cold-rolled ordered Fe—50Co—10V alloy using the EBSD method", Materials Characterization, Oct. 2019, pp. 1-13.
D. F. Susan et al, "The Effects of Annealing After Equal Channel Angular Extrusion (ECAE) on Mechanical and Magnetic Properties of 49Fe—49Co—2V Alloy", Metallurgical and Materials Transactions A, Sep. 2021, pp. 4090-4099.
"Office Action of Europe Related Application No. 21957463.9", issued on Oct. 8, 2024, pp. 1-13.
"Office Action of Europe Counterpart Application No. 21957462.1", issued on Oct. 8, 2024, pp. 1-11.
"Office Action of China Related Application No. 202180019418.5", with English translation thereof, issued on Mar. 12, 2024, p. 1-p. 11.
"Office Action of China Counterpart Application", issued on Nov. 12, 2024, with English translation thereof, pp. 1-12.

(Continued)

*Primary Examiner* — Jophy S. Koshy
*Assistant Examiner* — Joshua S Carpenter
(74) *Attorney, Agent, or Firm* — JCIPRNET

(57) ABSTRACT

Along with higher performance of products, materials are also required to achieve both a high strength and favorable magnetic properties according to applications of products. Therefore, the present invention provides an Fe—Co-based alloy bar which enables both a high strength and favorable magnetic properties to be achieved.
An Fe—Co-based alloy bar contains 30% to 80% of crystal grains having a grain orientation spread (GOS) value of 0.5° or more in terms of an area ratio, and having an average crystal grain size number of more than 8.5 and 12.0 or less. The Fe—Co-based alloy bar of the present invention has a high 0.2% yield strength after magnetic annealing so that it can support various high-strength applications.

1 Claim, No Drawings

(56) References Cited

OTHER PUBLICATIONS

"Office Action of China Related Application No. 202180075819.2", issued on Nov. 23, 2024, with English translation thereof, pp. 1-10.
"Office Action of Related U.S. Appl. No. 17/909,438", issued on Nov. 14, 2024, pp. 1-9.
"International Search Report (Form PCT/ISA/210) of PCT/JP2021/009570," mailed on May 25, 2021, with English translation thereof, pp. 1-6.
"International Search Report (Form PCT/ISA/210) of PCT/JP2021/033818," mailed on Nov. 30, 2021, with English translation thereof, pp. 1-6.
"International Search Report (Form PCT/ISA/210) of PCT/JP2021/033819," mailed on Nov. 30, 2021, with English translation thereof, pp. 1-6.
"Office Action of U.S. Related Application, U.S. Appl. No. 18/037,075", issued on Feb. 13, 2025, p. 1-p. 29.
Mohamed Sakr et al., "A comprehensive review on applications of ohmic heating (OH)", Renewable and Sustainable Energy Reviews, Jul. 31, 2014, pp. 262-269, vol. 39.
"Office Action of U.S. Related Application, U.S. Appl. No. 17/909,438", issued on Feb. 12, 2025, p. 1-p. 32.
"Office Action of Related U.S. Appl. No. 17/909,438", issued on Jul. 16, 2025, pp. 1-26.
"Office Action of Related U.S. Appl. No. 18/037,075", issued on Jul. 22, 2025, pp. 1-24.
Martin Raulf, Karin Persson, "Rolling of Steel", Encyclopedia of Lubricants and Lubrication, Theo Mang (eds), 2014, pp. 1663-1680.

* cited by examiner

Fe—Co-BASED ALLOY BAR

CROSS-REFERENCE TO RELATED APPLICATION

This application is a 371 application of the International PCT application serial no. PCT/JP2021/033818, filed on Sep. 14, 2021. The entirety of each of the above-mentioned patent applications is hereby incorporated by reference herein and made a part of this specification.

TECHNICAL FIELD

The present invention relates to an Fe—Co-based alloy bar.

BACKGROUND ART

Bars of an Fe—Co-based alloy represented by Permendur, which is known as an alloy having excellent magnetic properties, are used in various products such as sensors, cylindrical magnetic shields, solenoid valves, and magnetic cores. As a method for manufacturing an Fe—Co-based alloy bar, for example, Patent Literature 1 describes that an ingot is heated to 1,000° C. to 1,100° C. and then hot-processed into a billet of about φ90 mm, scratches on the surface and the like are removed with a lathe, heating is performed at 1,000° C. to 1,100° C., and then a hot-rolled material (bar) of about φ6 to φ9 mm is produced.

CITATION LIST

Patent Literature

[Patent Literature 1]
Japanese Patent Laid-Open No. H7-166239

SUMMARY OF INVENTION

Technical Problem

Along with higher performance of the above products, for example, products such as solenoid valves are becoming smaller, and it is required to achieve both a high strength and favorable magnetic properties. In the conventional manufacturing method as described in Patent Literature 1, achievement of both the strength and magnetic properties as described above has not been examined, and there is room for further studies. Therefore, an objective of the present invention is to provide an Fe—Co-based alloy bar which enables both a high strength and favorable magnetic properties to be achieved.

Solution to Problem

The present invention provides an Fe—Co-based alloy bar containing 30% to 80% of crystal grains having a grain orientation spread (GOS) value of 0.5° or more in terms of an area ratio, and having an average crystal grain size number of more than 8.5 and 12.0 or less.

Advantageous Effects of Invention

According to the present invention, it is possible to obtain an Fe—Co-based alloy bar suitable for applications for which both a high strength and favorable magnetic properties are required.

DESCRIPTION OF EMBODIMENTS

Hereinafter, an embodiment of the present invention will be described. The Fe—Co-based alloy bar of the present invention is a straight bar-shaped bar having a circular (or elliptic) cross-sectional shape or a rectangular cross-sectional shape. When the Fe—Co-based alloy bar is a round bar, the diameter is 5 to 20 mm. Here, regarding bars other than round bars, the equivalent circle diameter of the horizontal cross section may be 5 to 20 mm. Unless otherwise specified, the bar of the present embodiment is a round bar having a circular cross-sectional shape.

First, in the present embodiment, a hot-rolled material of an Fe—Co-based alloy is prepared. The Fe—Co-based alloy in the present invention refers to an alloy material containing 95% or more of Fe+Co in mass % and containing 25 to 60% of Co. Thereby, a high magnetic flux density can be exhibited.

Next, elements that may be contained in the Fe—Co-based alloy of the present invention will be described. In order to improve processability and magnetic properties, the Fe—Co-based alloy of the present invention may contain a total of one, two or more elements of V, Si, Mn, Al, Zr, B, Ni, Ta, Nb, W, Ti, Mo, and Cr in a maximum mass % of 5.0%. In addition, examples of impurity elements that are unavoidably incorporated include C, S, P, and O, and for example, the upper limit of each element is preferably 0.1%.

An Fe—Co-based alloy bar of the present invention contains 30% to 80% of crystal grains having a grain orientation spread (GOS) value of 0.5° or more in terms of an area ratio. This GOS value can be measured by a conventionally known "electron backscatter diffraction (SEM-EBSD) method," and can be derived by calculating the orientation difference of points (pixels) constituting crystal grains. The crystal orientation difference obtained from the GOS value is an index indicating the strain imparted to the alloy by processing, and when the bar contains 30% or more of crystal grains having a GOS value of 0.5° or more in terms of an area ratio, the driving force for crystal grain growth is introduced into the bar, and there is an advantage of favorable magnetic properties being obtained. Here, one feature of the present invention is that the upper limit of crystal grains having a GOS value of 0.5° or more is set to 80% in terms of an area ratio. Due to this feature, it is possible to minimize excessive coarsening of crystal grains and increase the strength of the bar without deteriorating magnetic properties. When the area ratio of crystal grains having a GOS value of 0.5° or more is less than 30%, favorable magnetic properties cannot be obtained because the bar has an insufficient driving force for crystal grain growth. The lower limit of the area ratio is preferably 35%, and more preferably 40%. In addition, when the area ratio of crystal grains having a GOS value of 0.5° or more exceeds 80%, the magnetic properties are improved but the strength tends to decrease. The upper limit of the area ratio is preferably 78%, and more preferably 75%. Here, the crystal grains having a GOS value of 0.5° or more can be observed in the cross section in the direction perpendicular to the axis of the bar. In addition, the cross section in which the area ratio is observed includes a cross section in the direction perpendicular to the axis and a cross section in the axial direction, but the area ratio is preferably 30% to 80% in both cases of observing the cross section in the direction perpendicular to the axis and the cross section in the axial direction of the bar. This is because the effect of strain due to rolling traces generated in the base material during the hot rolling step is easily observed in the cross section in the axial direction of the bar, and the area ratio observed in the cross section in the axial direction may be smaller than the area ratio observed in the cross section in the direction perpendicular to the axis. Therefore, even in the cross section in the axial direction in which the area ratio tends to be small, the effect of the present invention can be more reliably achieved if the numerical value of the area ratio is satisfied.

In addition, the average crystal grain size number of the Fe—Co-based alloy bar of the present invention is preferably more than 8.5 and 12.0 or less. Thereby, it tends to be possible to reliably obtain a high-strength alloy bar while exhibiting favorable magnetic properties after magnetic annealing. The lower limit of the average crystal grain size number is more preferably 9.0 or more, and the upper limit of the average crystal grain size number is more preferably 11.5 or less. The upper limit of the average crystal grain size number is still more preferably 11.0 or less. Here, the average crystal grain size number can be measured based on JIS G 0551. Thus, it can be measured in the cross section in the direction perpendicular to the axis or the cross section in the axial direction of the bar. Here, the strength of the Fe—Co-based alloy bar of the present invention can be evaluated according to the 0.2% yield strength measured according to a room temperature tensile test. In order to support various high-strength applications, the bar of the present invention preferably has a 0.2% yield strength of 200 MPa or more after magnetic annealing. The 0.2% yield strength is more preferably 210 MPa or more. The 0.2% yield strength may be measured based on the metal material tensile test method of JIS Z 2241.

Next, an example of a manufacturing method through which an Fe—Co-based alloy bar of the present invention can be obtained will be described. In the present embodiment, as an intermediate material of the Fe—Co-based alloy bar, a billet obtained from an Fe—Co-based alloy steel ingot having the above components is hot-rolled, and thereby a hot-rolled material can be obtained. Since an oxidized layer is formed by hot rolling in this intermediate material, for example, a polishing step in which the oxidized layer is mechanically or chemically removed may be introduced. This hot-rolled material has, for example, a shape of a "hot-rolled bar" corresponding to an Fe—Co-based alloy bar. Thus, in consideration of processability in the post-step, the diameter may be 5 to 20 mm. Here, regarding bars other than round bars, the equivalent circle diameter of the horizontal cross section may be 5 to 20 mm. Here, in order to satisfy the area ratio of crystal grains having a GOS value of 0.5° or more of the present invention, it is preferable that no solution treatment be performed on the hot-rolled bar. The solution treatment is a treatment in which the hot-rolled bar is heated at, for example, 800 to 1,050° C., and then rapidly cooled. Thus, it is preferable to perform a heating straightening step to be described below without performing the solution treatment.

<Heating Straightening Step>

In the present embodiment, a heating straightening step is performed in which tensile stress is imparted to the above hot-rolled material while heating is performed. In this case, if the hot-rolled material has a "bar" shape, it is pulled in the length direction of the hot-rolled bar, and thus the tensile stress is imparted. According to this step, it is possible to obtain a bar having very favorable magnetic properties and straightness while imparting residual strain to the hot-rolled material. The heating temperature in this case is set to 500 to 900° C. If the temperature is lower than 500° C., the processability decreases, and the bar may break when tensile stress is imparted. On the other hand, if the heating temperature exceeds 900° C., it is not possible to impart a preferable residual strain to the hot-rolled material. In the heating straightening step, the lower limit of the heating temperature is preferably 600° C., and more preferably 700° C. In addition, the upper limit of the heating temperature is preferably 850° C., more preferably 830° C., and still more preferably 800° C. Here, when the above solution treatment step is omitted, the lower limit of the heating temperature is preferably 700° C., more preferably 730° C., and still more preferably 740° C.

In this heating straightening step, it is possible to use a heating means such as ohmic heating in which a direct current flows through a conductive object to be heated and heating is performed with Joule's heat due to the internal resistance of the object to be heated or induction heating, but ohmic heating is preferably applied so that an effect of facilitating aligning of the axis of easy magnetization of crystal grains in the hot-rolled material in a certain direction is obtained and it has an advantage of being able to rapidly (for example, within 1 minute) and uniformly heat the material to a target temperature. In addition, the tension during the heating straightening step is preferably adjusted to 1 to 4 MPa in order to obtain a desired residual strain more reliably. In addition, it is preferable to adjust the elongation to 3 to 10% with respect to the full length before the heating straightening step.

In the present embodiment, regarding the bar that has been subjected to the heating straightening step, centerless polishing may be performed using, for example, a centerless grinder. Thereby, the unfinished surface on the bar surface layer can be removed, and the roundness and tolerance accuracy of the shape can be further improved. In the present invention, since the straightness of the bar is improved according to the heating straightening step, centerless polishing can be performed without cutting a long bar having a length of 1,000 mm or more.

EXAMPLES

Example 1

An Fe—Co-based alloy steel ingot having a composition shown in Table 1 was formed into an ingot and then hot-rolled to prepare a (Φ11.5 mm hot-rolled bar.

<Sample No. 1 and Sample No. 2>

The above hot-rolled bars were subjected to a heating straightening step in which the hot-rolled bar was pulled in the length direction under a condition of a tension of 2.7 MPa while heating so that the temperature of the bar was 750° C. to produce Fe—Co-based alloy bars of Sample Nos. 1 and 2, which are examples of the present invention.

<Sample No. 3>

The above hot-rolled bars were subjected to a solution treatment in which the bar was heated at 850° C. and then rapidly cooled and then subjected to a heating straightening step to produce an Fe—Co-based alloy bar of Sample No. 3 which is a comparative example. The conditions for the heating straightening step were the same as those in Samples No. 1 and No. 2.

<Sample No. 4>

The above hot-rolled bar was subjected to a solution treatment under the same conditions as in Sample No. 3, the heating straightening step was not performed, the other steps were performed in the same manner as in the example of the present invention, and thereby an Fe—Co-based alloy bar of Sample No. 4, which is a comparative example, was produced.

TABLE 1

(mass %)

| Sample No. | C | Si | Mn | Co | V | Remainder |
|---|---|---|---|---|---|---|
| 1 | 0.01 | 0.04 | 0.13 | 49.07 | 1.97 | Fe and unavoidable impurities |

TABLE 1-continued (mass %)

| Sample No. | C | Si | Mn | Co | V | Remainder |
|---|---|---|---|---|---|---|
| 2 | 0.01 | 0.04 | 0.13 | 49.25 | 1.99 | Fe and unavoidable impurities |
| 3 | 0.01 | 0.04 | 0.13 | 49.01 | 1.97 | Fe and unavoidable impurities |
| 4 | 0.01 | 0.03 | 0.13 | 49.01 | 1.98 | Fe and unavoidable impurities |

Next, the average crystal grain size, the GOS value and the DC magnetic properties of the samples of examples of the present invention and the comparative example were confirmed. For the average crystal grain size, in the horizontal cross section (cross section in the direction perpendicular to the axis), using an optical microscope (commercially available from Olympus), 10 fields of view of 500 μm×350 μm were observed, and the particle size number was determined on the crystal grain size standard drawing plate I according to JIS G 0551. The GOS value was determined using a field emission scanning electron microscope (commercially available from ZEISS) and an EBSD measurement/analysis system orientation-imaging-micrograph (OIM) (commercially available from TSL). For Sample No. 1 and Sample No. 4, the horizontal cross section (cross section in the direction perpendicular to the axis) was observed, and for Sample No. 2 and Sample No. 3, the vertical cross section (cross section in the axial direction that passes through the central axis) was also observed in addition to the above horizontal cross section of the sample. The measurement field of view was 100 μm×100 μm, and the step distance between adjacent pixels was 0.2 μm. In addition, observation was performed under the condition in which a boundary having an orientation difference between adjacent pixels of 5° or more was able to be distinguished from a crystal grain boundary, and from the obtained GOS value map, an area ratio with respect to the entire observation field occupied by crystal grains having a GOS value of 0.5° or more was obtained. Regarding the DC magnetic properties, a sample was collected from the obtained bar, and magnetic annealing was then performed at 850° C.×3 hours, and the maximum magnetic permeability and a coercive force were measured using a DC magnetization specific test device. Table 2 shows the observation results.

TABLE 2

| Sample No. | Average crystal grain size number | Area ratio (%) of crystal grains having a GOS value of 0.5° or more: Vertical cross section | Horizontal cross section | Maximum magnetic permeability | Coercive force (A/m) | Note |
|---|---|---|---|---|---|---|
| 1 | 9.0 | 62.5 | 40.2 | 18,600 | 42 | Example of present invention |
| 2 | 11.0 | 68.3 | 71.7 | 17,000 | 43 | Example of present invention |
| 3 | 8.0 | 85 | 87 | 19,600 | 39 | Comparative example |
| 4 | 9.0 | 8.6 | — | 8,400 | 68 | Comparative example |

Based on Table 2, it was confirmed that Sample No. 1 and Sample No. 2, which are examples of the present invention, had a larger average crystal grain size number than the comparative example (had a smaller crystal grain size than the comparative example), and regarding the area ratio of crystal grains having a GOS value of 0.5° or more, the example of the present invention had a smaller value of the area ratio than the comparative example. Regarding the magnetic properties, Samples No. 1 to No. 3 had higher magnetic permeability and a lower coercive force than the conventional example. Accordingly, it was confirmed that Samples No. 1 and No. 2, which are examples of the present invention and Sample No. 3, which is the comparative example, had better magnetic properties than the conventional example.

Example 2

Regarding the bars of No. 1 to No. 3 on which magnetic annealing was performed at 850° C.×3 hours, the 0.2% yield strength was measured at room temperature. For the test piece used for measurement, ½ scale of the JIS No. 4 test piece defined in JIS Z 2241 was used, and the 0.2% yield strength was measured based on the metal material tensile test method of JIS Z 2241. Table 3 shows the results. Based on the results of Table 3, it was confirmed that the example of the present invention in which the area ratio of crystal grains having a GOS value of 0.5° or more was 30 to 80% had a better 0.2% yield strength than the comparative example in which the area ratio of crystal grains having a GOS value of 0.5° or more was more than 80%. Accordingly, the Fe—Co-based alloy bar of the present invention had both favorable magnetic properties and a high mechanical strength, and is suitable for various product applications, for example, sensors, cylindrical magnetic shields, solenoid valves, and magnetic cores.

TABLE 3

| Sample No. | 0.2% yield strength [MPa] |
|---|---|
| 1 | 211 |
| 2 | 213 |
| 3 | 191 |

What is claimed is:

1. An Fe—Co-based alloy bar comprising 25 to 60% of Co, a total of one or more elements of V, Si, Mn, Al, Zr, B, Ni, Ta, Nb, W, Ti, Mo, and Cr in a maximum mass % of 5.0%, and 95% or more of Fe and Co in mass %, wherein a diameter of a circular cross-sectional shape of the Fe—Co-based alloy bar is in a range of 5 mm to 20 mm, an area ratio of crystal grains having a grain orientation spread (GOS) value of 0.5° or more measured by electron backscatter diffraction (SEM-EBSD) method is 30% to 80%, and an average crystal grain size number as measured according to JISG-0551 is more than 8.5 and 12.0 or less.

* * * * *